US012092431B2

(12) United States Patent
Lundgren

(10) Patent No.: US 12,092,431 B2
(45) Date of Patent: Sep. 17, 2024

(54) METHODS, SYSTEMS AND DEVICES FOR ROTATIONAL INCONSTANT DETERMINATION OF EULER'S ROTATIONAL RIGID BODY VECTOR EQUATION OF MOTION, FORMATION OF DYNAMIC ROTATIONAL LOADING PROFILES, AND THREE DIMENSIONAL TERRACRAFT TRAJECTORY CONSTRUCTION

(71) Applicant: Ronald Gene Lundgren, Highlands Ranch, CO (US)

(72) Inventor: Ronald Gene Lundgren, Highlands Ranch, CO (US)

( * ) Notice: Subject to any disclaimer, the term of this patent is extended or adjusted under 35 U.S.C. 154(b) by 81 days.

(21) Appl. No.: 18/083,496

(22) Filed: Dec. 17, 2022

(65) Prior Publication Data

US 2023/0117217 A1 Apr. 20, 2023

(51) Int. Cl.
*F41G 7/00* (2006.01)

(52) U.S. Cl.
CPC ..... *F41G 7/001* (2013.01)

(58) Field of Classification Search
CPC ..... F42G 7/001
USPC ..... 235/417
See application file for complete search history.

(56) References Cited

U.S. PATENT DOCUMENTS 5,929,370 A 6/1999 Brown
6,128,955 A 10/2000 Mimura
8,998,717 B2 4/2015 Parke
9,140,717 B2 9/2015 Perkins
10,118,696 B1 * 11/2018 Hoffberg ..... B64C 39/001
11,712,637 B1 * 8/2023 Hoffberg ..... F42B 10/64 701/2

(Continued)

FOREIGN PATENT DOCUMENTS

NL 3385937 B1 8/2012

OTHER PUBLICATIONS

SAND97-2426 Penetration Equations: Young discloses the Euler Solution of F=A, where A = S, his empirically developed geologic media Terramedia strength P4.1, 4.2, 4.3, 4.4, 4.5 pp. 9-12. He does not disclose the Coriolis acceleration addition to the Axial loading, Oct. 1997.

(Continued)

*Primary Examiner* — Allyson N Trail

(57) ABSTRACT

Methods, systems, and devices solving Euler's rotational rigid body equation of motion, formed within two non-inertial frames of reference, that determine the vector inconstant variables of angular acceleration, velocity, and trajectory using a single piezoresistive accelerometer sensor, an ΔC coupling algorithm and $1^{st}$ and $2^{nd}$ running integrals to in-flight acquire rotational inconstants in high-density Terramedia Terraflight and determine a Penetrator's loading profiles and method to parse vector Terraflight for rotational Pitch and Yaw enabling precision trajectory tracking utilizing three axial facing piezoresistive accelerometers, a differencing algorithm and $1^{st}$ and $2^{nd}$ running integrals enabling Penetrator flight control and precision guidance.

2 Claims, 12 Drawing Sheets

(56) References Cited

U.S. PATENT DOCUMENTS

| | | | | |
|---|---|---|---|---|
| 2014/0244210 | A1* | 8/2014 | Cobbin | G01B 21/22 702/151 |
| 2016/0349026 | A1* | 12/2016 | Fairfax | F42B 10/26 |
| 2017/0103151 | A1* | 4/2017 | Snider, Sr. | G06F 30/23 |
| 2020/0080912 | A1* | 3/2020 | Raichle | G01M 10/00 |

OTHER PUBLICATIONS

SAND98-0978 Simplified Analytical Model of Penetration with Lateral Loading: Youngs Model for Penetration is discloses the Euler Solution F=A (P2.3 p. 5) and empirically determines the strength of a Torque Impulse on the hose from his developed Terramedia strength constant S (P2.4 p. 7). Young then applies Newton's lateral loading analog (P2.5 p. 11). Young does not disclose the existence of a Coriolis Term or its acceleration transfer to the axial axis or the spatial I extreme loading of Rw/\2 Pulses to the lateral axiis or the existance of the Coriolis term hiden, May 1998.

* cited by examiner $F = A + BV + CV^2$ → PONCELET → $F = A + CV^2$ → EULER → $F = A$ $F$ = Force = Mass * Acceleration A = Target Strength $V$ = Velocity $BV$ = Stokes/Viscous Drag (Penetrator sidewall friction)

$CV^2$ = Dynamic Pressure Drag $CV^2 = \frac{1}{2}\rho V^2 A_s C_d$ $\rho$ = *Density of the Terramedia*

$A_s$ = *Area of the Shank* *Fig. 2*

$V$ = *Velocity*

$C_d$ = *Drag Coefficient*

RUNNING TRACKING SOLUTION TO EULER'S VECTOR ROTATIONAL EQUATIONS OF MOTION FOR A RIGID BODY

VERIFICATION OF AC COUPLED ALGORITHM OF FIG. 5

RUNNING DIFFERENCE TRACKING SOLUTION FOR PENETRATOR PITCH AND YAW USING 3 AXIAL FACING ACCELEROMETER SENSORS

METHODS, SYSTEMS AND DEVICES FOR ROTATIONAL INCONSTANT DETERMINATION OF EULER'S ROTATIONAL RIGID BODY VECTOR EQUATION OF MOTION, FORMATION OF DYNAMIC ROTATIONAL LOADING PROFILES, AND THREE DIMENSIONAL TERRACRAFT TRAJECTORY CONSTRUCTION

TECHNICAL FIELD

The present specification relates to the use of the Euler Coriolis acceleration to determine the inconstant rotational properties and in-flight construct the traversed axial and angular path of a ballistic projectile Terraship, presently termed a "Penetrator", and the technology, Terradynamics, termed to delineate the technical field's direct analog to Aerodynamic flight but thru high density (>>air) media and presently termed "Penetration". This present invention is based on the very creative postulate that flight, termed Terraflight, thru a high density media, termed Terramedia, FIG. 2, that is, in situ geologic or geologic constructed media relative to aerodynamic flight thru air is dominated by Euler's $2\omega X v_r$ (bold face equation terms are vectors while non bolded terms are scalers) and post Euler named the Coriolis acceleration, FIGS. 6 and 8; 120 and further force on the Penetrator body, FIG. 2, during Terraflight is not dominated by dynamic pressure drag, FIG. 1 $CV^2$, in a Penetrator body non-inertial reference frame, that is, a frame that experiences acceleration, as is the case in Aerodynamics, rather is governed by the strength of the target "A", FIG. 1, and high density Terramedia Terraflight within a $2^{nd}$ non-inertial polar reference frame, FIG. 8, which contains the Euler Coriolis acceleration term and in the same manner that the Euler Coriolis acceleration is formed in Orbital mechanics, where falling to a lower orbit (an orbit with a smaller radius to its center of rotation) is deceleration and jumping to a higher orbit (larger radius) is acceleration. This does not intuitively follow from one skilled in the art of Aerodynamics, nor does it intuitively follow that the lateral kinematics is not dominated by Penetrator body forces in a Penetrator body non-inertial cartesian reference frame, FIG. 6, that is, lateral angular velocity ω (Omega), acceleration α (Alpha) and traversed path θ (Theta) are dominated in flight by the $2^{nd}$ non-inertial "spatial" reference frame, FIG. 8, specifically the Euler Coriolis acceleration. This discovery permits a solution to Euler's rotational rigid body vector equation of motion to be formed, heretofore only solvable in special cases such as a vacuum, and further allows the Penetrator traversed path θ (Theta), during Terraflight thru a high density Terramedia to be point by measured point acquired, in real time, allowing guidance and control of the Penetrator to be implemented during Terraflight.

BACKGROUND

The original equation for the axial force, FIG. 1, experienced by a Penetrator during Terraflight was postulated by Euler and Poncelet in the 18th and 19th century respectively. Their axial equation is $F=A+BV+CV^2$, FIG. 1. Researchers over the years dropped the BV term, which is Stokes/Viscous Drag, as Penetrator Terraflight thru a high density Terramedia are known to form an angular path, that is, turn thru an arc, which is not possible if the Penetrator shank, FIG. 2, were in contact with a high-density Terramedia, such as rock or cast in place concrete, during flight. The nose of the Penetrator during Terraflight dynamically forms a clear space around a created tunnel/cavity and termed dynamic cavity expansion and known as "Cavitation", FIG. 2, of very low-density dust and air around the shank and replenishes it during the angular flight path giving the Penetrator an unobstructed clear space in which to rotate and form an angular arc. The BV term during Penetrator Terraflight does act at velocities <100'/sec where insufficient momentum is available to cavitate and form a clear space for an angular path. The result being that the BV term, which is simply side friction tending to inhibit flight, contributes little to the axial flight path in a negative sense but does straighten out the formed arc, that is, the Penetration depth is substantially the same and the angular motion is partially damped. Additionally, empirical data for Cavitation supports the nose opening a tunnel/cavity that is larger than the projectile shank, FIG. 2. The importance of viscous drag loading is that it initiates a 'g' spike as the cavity collapses around the shank quickly stopping the Penetrator and known to researchers' as "slamming shut" at the end of the event, FIGS. 3 and 4, where one 'g' is the acceleration due to gravity at the Earth's surface and is the standard unitless gravity symbol 'g' or 'G'. This spike is troublesome for Penetrator internal cavity carried small components. As shown on FIG. 1 Poncelet reduced the equation to $F=A+CV^2$. Euler, who predated Poncelet dropped the $CV^2$ term as well as the BV term reducing the equation to F=A. In the last half of the $20^{th}$ century this contrivance was attributed to Euler as a simplification on Euler's part to remove the difficulty of solving a non-linear differential equation. Euler's removal of these terms produces a square wave solution, FIG. 3, for totally axial events and that has been confirmed by empirical data. Euler is considered the greatest mathematician to date, and it is most likely that he was not prone to mathematical estimates and short-cuts as applied to non-linear differential equations rather, he was closer to the physics of Penetration than modern researchers for velocities between 100 and 1100'/sec, which is the majority of impact conditions for high density Terramedia Penetrator Terraflight. The US National Laboratories in the 1960's began the effort to understand and analyze Penetrator Terraflight thru high-density Terramedia. The primary researcher was C. Wayne Young. This effort consumed 50+ years and many millions of research dollars. Young's initial postulate was a system analogous to Aerodynamics and subject to the same equations only with an extremely high density, relative to air, Terramedia. In this postulate the dynamic pressure would dominate. Young termed this innovative technology "Terradynamics" to demonstrate its close fit to the field of Aerodynamics.

In the early 1900's Petry solved Poncelet's reduced equation for depth as a function of geometry and initial conditions of impact velocity. This was the technology starting point for the United States' National Laboratories. However, the mathematical "log" terms that resulted from the solution were troublesome for users in the early days of charts and a piece-wise mathematical equation fit of Petry's solution was developed by Young, letting the lower velocities cover the Petry solutions' non-linear curvature with the result that at velocities, greater than 100'/sec, the depth versus velocity for a geometry approximated a straight line. The National Laboratories, under the purview of Young, then conducted well over a thousand tests and fit straight lines over all geometries and velocities up to 2500'/sec. Out of this came Young's two-dimensional accurate empirical code SAMPLL (Simplified Analytical Model for Penetration with Lateral Loading). Since two derivatives of the test results always resulted in a square wave, due to lack of resolution in measurement of displacement versus time during the early test era, the National Laboratories were determining the "A" term of Euler's equation for Penetration. At that time the National Laboratories Researchers considered a square wave solution, that is, the Euler solution, not to be the solution to the high-density Penetration problem; rather it resulted from lack of data resolution but was a good estimate none the less. Other National Laboratory researchers, beginning in the 1980's forward, also started with Poncelet's equation taking the requisite integrals to determine axial depth as a function of geometry and initial conditions. As with previous research one winds up with acceleration time being a composite of both terms, FIG. 1, in Poncelet's formulation. Poncelet's "A" term was named the DC constant term, and $CV^2$ the momentum term. The solution is graphically shown in FIG. 1. Initially National Laboratory researchers attempted to define the "A" term with respect to the material properties of the Terramedia (the Penetrator geometry falls out from the integrations), but this yielded little success other than requiring a costly set of tri-axial compression tests, under guessed at pressures exerted on the Terramedia by the Penetrator, to be conducted to properly quantify the Terramedia strength, that is the DC term. The result of this effort was a suite of additional tests that only served to add many more variables to the solution. And so, the researchers re-settled on the Young approach, that is, to empirically determine a constant that represented Terramedia material strength, termed "S" and developed by Young. The deterministic $CV^2$ term, which is now known to apply at velocities above 1100'/sec, is though well defined. It is, as in Aerodynamics and shown on FIG. 1, linearly proportional to media density and Penetrator geometry, but non-linearly proportional to the square of the velocity; the drag coefficient is a singular empirical term but well defined as a number between 0.1 and 2. Further, the drag coefficient is an empirically determined constant to make up for using the entire area of the shank, FIGS. 1 and 2, in the calculation for $CV^2$. It corrects for the actual amount of area exposed to a media and its values have been fully catalogued by geometry. Towards the end of Young's career, the National Laboratories were able to measure hi-fidelity deceleration histories of high-density Terramedia Terraflights. The returned results for axial only flight (no turning/lateral loading) were found to be the Euler solution, that is, a near square wave up to 1100'/sec. This produced what is now an amazing discovery. Since, per Euler, the target strength "A" up to 1100 ft/sec governs, then penetrator deceleration thru high density Terramedia is independent of velocity, either striking or draining. The amazing part of this is that, per Euler, all media has a unique number associated with it, and that number is peak "g's." Further, media can be identified absolutely, while in Terraflight, allowing Department of Defense smart fuzing concepts to be developed and implemented content in the knowledge that the associated smart algorithms know where the Penetrator is and in what media it is traversing. Further it has important applications to terrestrial bodies, allowing probes to determine the make-up of a terrestrial regolith.

Poncelet's axial force equation solution, shown graphically in FIG. 1, is an accurate model for high density Terramedia Terraflight and therefore the "A" term must dominate since one sees little trapezoidal shape in the data up to 1100'/sec. The "A" term is the "S" number from Young's equations, reference his computer code SAMPLL, and was the focus of his 40+ years of National Laboratory and Department of Defense work. Further, researchers know the $CV^2$ term variables. The variables are defined very narrowly in FIG. 1. All factors except p are known, that is, $C_d$ is a number between 0.1 and 2 but constant for any singular event, V is the applied velocity and $A_S$ is the shank area, again constant for any singular event; and the ½ is a constant. Scoping calculations demonstrate the $CV^2$ term is exceptionally large if we use densities of rock, soil, even water. Therefore, to annihilate this term i.e., relegate it to the noise level and be in concert with Euler's proven solution, F=A, it must be low density, that is, air or dust, as none of the other terms can change. And so, the answer is the drag term is air drag, which now defines its drag coefficient value, with the "A" term representing the resistance of the media to pushing the Terramedia particles aside and forming a tunnel/cavity to allow the Penetrator to pass and only at velocities >than 1100'/sec. does it enter the graphical solution of FIG. 1. This original assumption then, that there is a direct analog between Aerodynamics and Terradynamics is incorrect, rather they are opposites. In Aerodynamics the "A" term is negligible and represents the work required to push the air away, and so in Aerodynamics the dynamic pressure governs and in Penetration, the "A" term dominates as it represents the work required to push a high-density Terramedia away, forming a tunnel/cavity for a Penetrator to traverse, FIG. 2. Therefore, Aerodynamics and Terradynamics are polar opposites, rather than analogs of each other as originally postulated by researchers, with the exception of Euler.

Euler's solution F=A, is a trapezoidal (to account for signal rise and fall times as no true square wave can exist in nature) DC constant amplitude wave axial solution, FIG. 3, to Penetrator Terraflight. It only applies to projectile normal impacts into homogeneous media and perfectly machined noses. These are rare occurrence as Penetrator Terramedia impacts are:

Rarely normal when air delivered and

Even when normal deliveries are achieved, such as a controlled gun delivery, the noses are rarely symmetrically loaded; rather asymmetrically loaded by the Terramedia in Terraflight inducing torque impulses, that is, side pressure at a nose side (called "center of pressure").

Researchers, having solved empirically the axial problem of Penetrator Terraflight, turned to Newton's linear impulse-momentum lateral rotational analog, FIG. 3, to solve the rotational problem set, termed lateral or side loading. This analogy required that the input rotational acceleration from an applied torque impulse to the nose be balanced by an equivalent deceleration pulse, that is, the acceleration positive pulse area be totally dropped by a deceleration pulse negative area, FIG. 3, as the projectile was observed to have stopped and therefore could not still have rotational velocity which is the same rational researchers applied to the axial case as a Penetrator is known to have stopped so the initial conditions of impact velocity must be expended during Penetrator Terraflight.

With these coded analytical tools in hand the Laboratory researchers considered that Terraflight thru a high-density Terramedia problem to be solved. FIG. 3 shows data graphs of the axial and lateral empirical code solution set vs: actual lateral and axial data for a Penetration event. Note, the Euler solution only applies to a totally axial Penetrator Terraflight, that is, the rare case of no lateral loading. The researchers of the 80's settled on developing enhanced empirical codes based on measurement data that matched the axial measurements; but left the rotational analog in place. The lateral kinematical loading was not fully understood and variances from Newton's rotational analog considered to be a result of media that were rife with different layering and therefore researchers never fully reconciled the empirical codes and formulas, that is, the undulations around the Euler solution, FIG. 3, were considered different hardnesses, that is, "A" value Terramedia layers.

In addition to axial empirical codes and formulas that match data specific to Terramedia and Euler's trapezoidal wave solution F=A, where A is the Terramedia resistance, this invention determines the angular kinematic properties of the Penetrator, that is, the angular acceleration $\alpha$ (Alpha), angular velocity $\omega$ (Omega) and traversed angular path $\theta$ (Theta), point by measured point during flight and sufficient to dynamically solve, the heretofore in closed form insoluble Euler vector rotational equation of motion for a rigid body of FIGS. 6 and 8; 120 with a singular axial piezoresistive accelerometer sensor, with an output in 'gs' $a_x$, and determine point by gathered point the Penetrator's body loading at any or several locations within and/or on a Penetrator in Terraflight by solving the separated difference equations, FIG. 6; 112.

Euler's rotational rigid body vector equation of motion separates into 3 scaler difference equations, FIG. 6; 112, one in the cartesian co-ordinate 'x', one in 'y' and one in 'z'. Importantly Euler's rotational rigid body vector equation of motion is "rotational", that is, while the "a" term in Euler's vector equation, FIG. 6; 120, includes axial translation, translation acceleration is removed as the equations are difference equations and removed in the solution for the rotational variables as difference equations remove common modes, in this case the Euler "A" solution. As an example, $\omega$ (Omega), when Euler's rotational rigid body vector equation of motion is separated consists of $\omega_x$ (Omega$_x$), $\omega_y$ (Omega$_y$), $\omega_z$ (Omega$_z$) and $\dot{\omega}$ consists of $\dot{\omega}_x$ (Alpha$_x$), $\dot{\omega}_y$ (Alpha$_y$), $\dot{\omega}_z$ (Alpha$_z$). Additionally, FIG. 6 shows the inertia and non-inertial Penetrator body frame for a typical particle m" on the Penetrator body with constant body co-ordinates. Further, Penetrator Terraflight contains a $2^{nd}$ non-inertial frame, FIG. 8, whereby the Penetrator itself is the typical particle and denoted as m'. The inertial frame for the two non-inertial frames is an imaginary box chosen to be at rest relative to the non-inertial frame during the Terraflight and substantially a land mass that does not experience acceleration "a" relative to the non-inertia frames, and which is in the physical case the Terramedia thru which the Penetrator is in Terraflight. The constant co-ordinates of m" force vector terms $\ddot{r}_0$ and $v_r$, FIG. 6; 120, to zero as they are $2^{nd}$ and $1^{st}$ derivatives respectively of m''s fixed (constant) co-ordinates; thus, the 3 separated equations take the form shown in FIG. 6; 112. Further, Terraflight does not have a roll component, which in Penetration technology is commonly designated 'x' in a Cartesian co-ordinate system and is the Penetrator's axial longitudinal axis. With this assignment all roll terms, $\omega_x$ (Omega$_x$) and $\alpha_x$ (Alpha$_x$) are substantially zero and Penetrator Terraflight rotates in Pitch 'y' $\alpha_y$ (Alpha$_y$) and Yaw 'z' $\alpha_z$ (Alpha$_z$) only. Reference FIG. 4, which is a typical 'x', 'y', 'z' gun launched Terraflight test data of Penetrator Terraflight, and the undulations around the axial Euler solution, which can also be seen in FIG. 3's lower left-hand graph and which appear when lateral (also known as side) loading is present. We know that these undulations are lateral loading appearing in the axial data as the Euler solution when no lateral loading is present is a constant amplitude trapezoidal DC wave and the only parameter changed is the addition of a torque impulse on the nose, either thru impact conditions or from target inhomogeneity. Further the separated equations from Euler's rotational rigid body vector equation of motion of FIG. 6; 112 are difference equations, that is, the axial aoxyz accelerations when moved to the left side of the equal sign become negative with respect to $a_{xyz}$ accelerations leaving only rotational terms on the right side of the equal sign and thereby for the axial case, $a_{0x}$ and $a_x$ consisting of the Euler "A" term, annihilate "A". Simply put the undulations around the Euler solutions, FIGS. 3 and 4, are the rotation terms of Euler's rotational rigid body vector equation of motion. Further, this is not in concert with Newton's rotational analog used by researchers, as can be seen in the FIGS. 3 and 4, as the lateral 'y' and 'z' accelerations are pulses. The lateral $a_{yz}$ accelerations 'g' loading are appearing in the axial 'x' axis as undulations around the Euler line, not in the 'y' or 'z' lateral axis. Further, the lateral loading, that is, 'y' and 'z' pulses have no compensating opposite polarity pulse to remove the acquired rotational velocity ($\omega$) Omega from an applied torque impulse on the nose. This can be verified by a visual $1^{st}$ integral (area under the lateral "y" and "z" pulse curves of FIGS. 3 and 4) that will yield a velocity value at the end of the event. The dilemma associated with previous researcher's use of Newton's lateral analog to axial loading is that lateral acceleration data $a_{yz}$ indicates the Penetrator still has rotational velocity at the events end although it was physically observed to have stopped. Returning to the separation of Euler's rotational rigid body vector equation of motion into 3 Cartesian co-ordinate equations FIG. 6 we note that the term $2\omega X v_r$ in 120 (where $v_r$ is the velocity toward or away from the center of spatial rotation and X is the mathematical cross product operator that transforms apparent lateral acceleration to axial acceleration as it shifts the term 90 degrees) is equivalently zero as it is the $1^{st}$ derivative of the vector constant co-ordinates of m" and the derivative of a constant is zero. We also notice that the lateral 'y' and 'z' pulses of FIG. 4 are large in amplitude and of a singular polarity. These lateral pulses therefore must contain a squared term which will appear, FIG. 6, as a body co-ordinate frame acceleration in 'z' and 'y' FIG. 6 Equations 2 and 3. FIG. 7 shows the centers of rotation for 'z' and 'y' and locations of the sensors with respect to the centers of rotation. However, since there is no roll in a Terraflight event terms, FIG. 6 Equations 2 and 3, $-y(\omega_x^2+\omega_z^2)$ and $-z(\omega_x^2+\omega_y^2)$ $\omega_x^2$ term must be substantially 0 and 'y' and 'z' co-ordinates multiplied by their respective $\omega^2$s are low level acceleration due to the very small body distance to their centers of rotation; simply put $y\omega_z^2$ and $z\omega_y^2$ are an order of magnitude or more down from the pulse signal and therefore cannot be the 'y' and 'z' pulses of FIG. 4. Therefore, a large magnitude non-body radius distance to a center of rotation must exist, that is, a spatial orbit center of rotation distance rather than the distance from m", the location of the acceleration sensor, to the body "B" origin point of rotation, $a_{0x}$ on the Penetrator body. The only large magnitude distance to a center of penetrator rotation, R, that can exist in a Penetrator flight system in Terramedia is the radius of the Penetrator flight "Path" i.e., Orbit FIG. 8, of the traversed angular path $\theta$ (Theta) in the Terramedia, that is, a $2^{nd}$ non-inertial frame must exist in a Terraflight event, and that frame must be a Polar co-ordinate reference frame where the Penetrator body, "B", FIGS. 6 and 8, as a whole is a typical particle termed m'. If a projectile is perfectly straight (has no bow) then an Orbital R starts at infinity. Practically, just as it is impossible to draw perfectly straight lines, there is always a bow (which produces a standard circle parameter chord length) when machining a projectile and therefore a Penetrator is born with large R, substantially several hundreds of feet due to machine tolerances and fabrication. This is several orders of magnitude larger than the body rotation radius value relegating the radii 'y' and 'z' $\omega^2$ body terms to integral contamination of acceleration measurements, that is, an average order of magnitude down compared to the spatial path $R\omega^2$ term and the Euler Coriolis acceleration $2\omega X v_r$. This small body rotation radius also applies to the acceleration terms $x(-\dot{\omega}_y)$ and $x(-\dot{\omega}_z)$ of FIG. 6; Eqs. 2 and 3. The spatial path $R\omega^2$ overwhelms these acceleration terms and therefore the signals appear as pulses. However, the terms can be identified in the signals with AC Coupling as $R\omega^2$ is a DC term and $\dot{\omega}_y$ and $\dot{\omega}_z$ are AC terms, that is, they are the Euler Coriolis scalers $2\omega v_r$. The lateral facing signals $a_y$ and $a_z$ do not contain the Euler "A" term and therefore the signals cannot be used to fully track the Penetrator movement.

Therefore, two non-inertia frames exist: 1) is the axial acceleration and lateral Penetrator body co-ordinate acceleration flight of the Penetrator shown in FIG. 6 of a cartesian non-inertial body co-ordinate system and 2) a non-inertial angular Terramedia path θ (Theta) in polar co-ordinates of FIG. 8 where the Euler Coriolis acceleration $2\omega v_r$ and $R\omega^2$ dominate the lateral loading. Further, during flight point by measured point a new circle is defined with a new Orbital R. This is called a continuum of elements that are not perceptibly different from each other but are additive and sum from element to element as the Penetrator traverses the angular path θ (Theta) thereby creating the pulses, that overwhelm body accelerations, shown in FIGS. 3 and 4. This addition and summing of adjacent elements is called a running continuum integral and determines the angular path θ (Theta). An example of a non-continuum is music. Music composed on a piano is a series of distinct detectable element steps introduced by the striking of one or simultaneously several piano keys.

The term $2\omega X v_r$, while equivalently 0 in the Penetrator body frame of FIG. 6, survives in the Terramedia spatial polar frame of FIG. 8, 124. This term was, after Euler's death, named the Coriolis acceleration after Gustave-Gaspard Coriolis a French Engineer and mathematician who discovered the paramount importance to ballistics of Euler's $2\omega X v_r$ acceleration. The "X" times sign is the mathematical vector cross product which mathematically rotates the action 90 degree to be in concert with the physical phenomena, from the singular Polar non-inertial reference frame rotation axis Z that is crossed with R sending the Euler Coriolis Term to the θ axis (which is the axial 'x' axis in the Cartesian non-inertial frame where θ is transformed to Body co-ordinates by the transformation 'x'=R*Cos(θ)=1 and 'y'=R*Sin (θ)=0 for very small (θ)) producing the undulations around the Euler solution line on the 'x' axis. However, the $-x(\omega_y^2+\omega_z^2)$ terms, 114, for the body 'x' co-ordinate contaminate the Euler Coriolis acceleration $2\omega v_r$ $1^{st}$ and $2^{nd}$ integrals and must be removed before the integrations. These undulations do balance the velocity, that is, rotational w (Omega) velocity input to a system by torque impulses is taken out by opposite polarity acceleration pulses and the method to recover this signal from a single axial facing accelerometer sensor that contains a (the Euler Coriolis acceleration) and ω (Omega) is with AC coupling of the signal. AC coupling was originally an analog Oscilloscope method of removing DC components from a signal. Its primary purpose was to remove DC shifts from the signal, usually caused by electrical grounding conditions, which would contaminate the $1^{st}$ and $2^{nd}$ Integrals of a signal. In this case the DC shift is the Euler Solution "A" as well as any analog electrical grounding anomalies and importantly the $-x(\omega_y^2+\omega_z^2)$ contaminates of FIG. 6; 114, as squared terms are signal rectifiers (the electrical method of changing an AC wave to a DC wave) and therefore removed by the AC coupling operation therefore removing from the axial acceleration sensor $a_x$ contaminates. This operation is now digital and is implemented in real time. In the digital case it is called "running AC coupling". Physically the projectile receives a torque impulse, normally by impact conditions, and by Newton's impulse-momentum laws initiates a rotational velocity, ω (Omega). The Penetrator now is in Terraorbit and not unlike a satellite in the vacuum of space except that the media has density. Velocities are relative, it does not matter who is moving, so consider the projectile to be on a counterclockwise constant rotating platform, FIG. 8, forming an angular path θ (Theta) at each measurement time step. As is the case in Orbital mechanics if the Penetrator's orbit decays, that is, its orbital radius is reduced, the Penetrator slows down (which is deceleration and a decreased rotational velocity ω Omega) and if the Penetrator's orbital radius increases then the projectile speeds up (which is acceleration and an increased Omega). One can feel this effect by standing in the middle of a counter-clockwise constant velocity rotating platform. Sidestep to the left and one feels the deceleration (a jerk backwards); sidestep to the right and one feels the acceleration (a jerk forward). Further, consider every point on a radius vector of a rotating platform. Each point circulates 360 degrees (2π Radians) in equal time. However, outer radius points travel a further distance then inner radius points. The outer radius points therefore have a higher rotational velocity then inner radius points, thereby when one changes position one must assume the new velocity, that is, accelerate or decelerate. Thus, a single axial accelerometer placed substantially ¾'s of a projectile body length behind the projectile nose torque impulse point and running an AC coupling algorithm to remove body $\omega^2$ (Omega$^2$) contaminates will determine the Penetrator kinematics, that is, its angular velocity ω (Omega), acceleration α(Alpha, which is the Euler Coriolis Acceleration) and path θ (Theta), thereby forming a solution to Euler's rotational rigid body vector equation of motion, heretofore considered in closed form insoluble outside a vacuum. Further note that the pulses in the lateral data as measured by an accelerometer, FIGS. 3 and 4, are $R\omega^2$. This term, $R\omega^2$, is a result of the triple product ωx (ωX r) in a polar non-inertial reference spatial frame, FIG. 8; 120, where only one axis, 'Z', experiences rotation. The squared term annihilates phase (a signal's positive and negative swings) and therefore ω and subsequently α with derivatives, cannot be recovered. However, ω(Omega$_{yz}$) and α (Alpha$_{yz}$) can be recovered in the directions of 'y' and 'z' facing accelerometers, Eqs. 2 and 3; Terms $x(-\dot{\omega}_z)$ and $x(-\dot{\omega}_y)$; FIG. 6, from the signal by AC coupling as $R\omega^2$ is a DC term but since 'y' and 'z' accelerometers do not contain axial translations (Euler's "A" term) tracking is not possible with this method of recovering Alpha$_{yz}$. Also, α (Alpha) and ω (Omega) are "properties" of a rigid body, that is, at any time step there is only one vector value of Alpha, one vector value of Omega and one vector value of Theta, simply put, it's the radius distance to the center of rotation that changes the acceleration value and AC coupling of the lateral accelerometers produce the scaler Euler Coriolis term.

This invention also provides the means to real time construct the in-flight trajectory of a Penetrator in Terraflight. Penetrators do not roll about the Penetrator primary longitudinal axial 'x' axis. A single axial accelerometer running an AC Coupling algorithm will determine the vector resultant of 'y' and 'z', that is, it will not parse 'y' and 'z' ω (Omega) and α(Alpha) terms. The parsing of 'y' and 'z' is recovered by using 3 axial facing accelerometers, that is, no 'y' or 'z' co-ordinate, in an "L" pattern of FIG. 11; 150, substantially placed at the tail of the projectile, FIG. 7, to increase the resolution as the center of rotation is at the nose. Since the Penetrator does not role during Penetration the origin of the co-ordinate system is known at impact. The spacing of the accelerometers around the "L" is substantially ⅕ of a body diameter. As shown in FIGS. 10, 11 and 12 a running digitization and difference is taken, where the vertical leg of the "L" is the Pitch difference, and the horizontal leg is the Yaw difference in units of 'gs' and the common terminal (which must lie on the primary longitudinal axis, FIG. 2, i.e., centerline) is the junction of the vertical and horizontal legs. Differencing is a close relative of AC Coupling. Differencing is used to annihilate common modes and vastly increase the signal to noise ratio of a signal. In the case of Penetrator Terraflight, the common modes are the Euler axial "A" solution, FIG. 1, and any rectified signal ω2 body contaminates, FIG. 6; Equation 1 (114) terms. After the difference is taken $1^{st}$ and $2^{nd}$ integrals are performed, 154 and 156 on FIG. 10, yielding $\omega_z$ (Omega$_z$) and $\omega_y$ (Omega$_y$) and $\Theta_z$ (Theta$_z$) & $\Theta_y$ (Theta$_x$) respectively, FIGS. 10 and 11. FIG. 12 shows the validation by test of this method for a penetration event into high density granite Terramedia where the Penetrator Yawed 19 degrees and did not Pitch. Tracking the trajectories of a Penetration event allow for the deployment of Terrafoils (drag surfaces as in wings in Aerodynamic flight) to correct the Terraflight trajectory and impact an underground target at its unprotected (un-hardened side) where a target is most vulnerable to attack and further track flight within a target. Further to "swim (colloquial for Terraflight)" in Terramedia to a target a low impact angle of incidence is needed, substantially 30 degrees above the horizontal. Penetrators have a high broach rate, that is, they seek a low-density Terramedia free surface on impact and will exit the high-density media into the low-density media. A 30-degree impact angle will broach substantially 90% of the time, when presented with an air media layer, and detection of broach and deployment of Terrafoils is required to right the trajectory and save the mission.

Accordingly, a need exists for methods, systems and devices for rotational in flight inconstant determination of Euler's rotational rigid body vector equation of motion, formation of dynamic rotational loading profiles and construction of the in-flight vector sum of the pitch and yaw trajectory for Penetrators in Terraflight and further form dynamic rotational loading profiles during Terraflight by acquiring the vector rotational variables of angular acceleration α(Alpha), angular velocity ω(Omega), and angular path θ (Theta) during the flight of a Penetrator thru Terramedia so as to determine the rotational loads at every point on a Penetrator and enabling vector trajectory position tracking to save the Penetrator's mission and properly acquire a target and further form algorithms and methods that construct in-flight vector parsed Pitch and Yaw trajectories of a Penetrator to enable precision tracking and guidance of the position of a Penetrator, point by acquired point, and enable the Penetrator to self-correct its trajectory with the in-flight deployment of Terrafoil drag surfaces and acquire a target during Penetrator geologic Terraflight.

SUMMARY

In the preferred embodiment a solution to Euler's rotational rigid body vector equation of motion is formed within two non-inertial frames of reference, dynamically determining the rotational inconstant variables of angular acceleration α(Alpha), angular velocity ω (Omega), and angular path θ (Theta), using a single axial accelerometer sensor, an AC coupling algorithm and $1^{st}$ and $2^{nd}$ running integral algorithms to enable vector tracking and control of the Terraflight in order to dynamically deploy Terrafoils and to provide a desired drag surface reaction force during Terraflight relative to the surrounding high density media and guide the Penetrator to the desired target.

In yet another embodiment a method to acquire the in-flight rotational inconstants and determine the Pitch and Yaw of a Penetrator and enable trajectory tracking utilizing 3 axial facing in plane accelerometer sensors placed in the tail of a penetrator, a differencing algorithm and $1^{st}$ and $2^{nd}$ running integral algorithms and enable the control of the flight in order to dynamically deploy Terrafoils to provide a desired precision Pitch and Yaw reaction force during Terraflight relative to the surrounding high-density media and precision guide the Penetrator to the desired target.

BRIEF DESCRIPTION OF DRAWINGS

The embodiment set forth in the drawings are illustrative and exemplary in nature and not intended to limit the subject matter defined by the claims. The following brief description of the illustrative embodiments can be understood when read in conjunction with the following drawings.

DETAILED DESCRIPTION OF DRAWINGS

Figure 1:
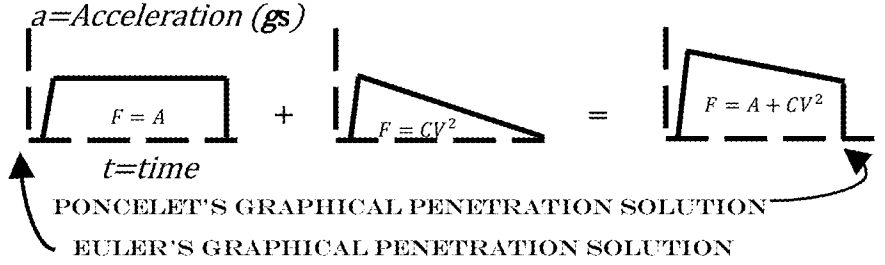
FIG. 1 depicts the Euler and Poncelet 'g' solutions to the Terraflight of a Penetrator in high density Terramedia.

FIG. 1 depicts the Euler and Poncelet 'g' loading mathematical formulation for Terraflight of a Penetrator thru high density Terramedia and shows graphical solutions of the Euler Poncelet formulations. The geometric and Terramedia variables and constants of the equation are defined.

Figure 2:
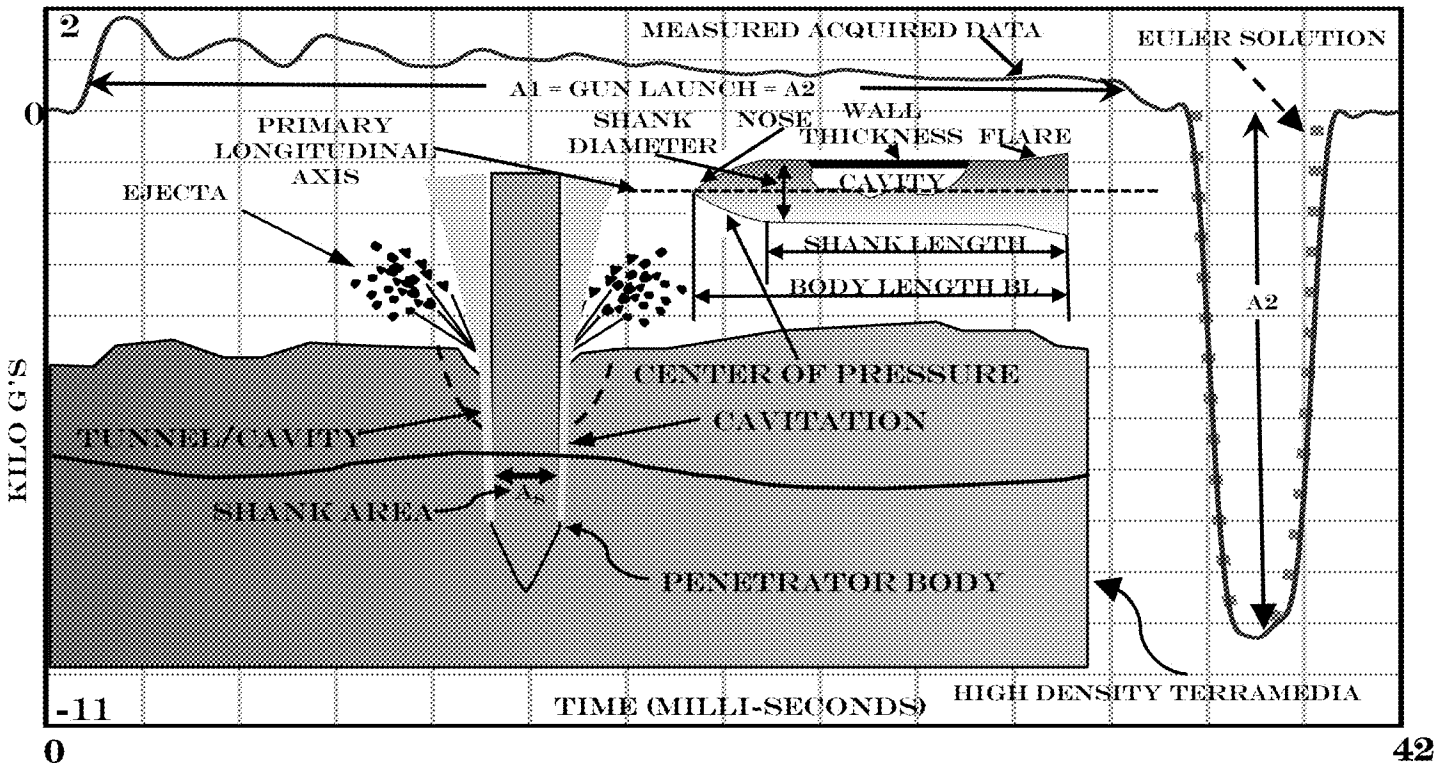
FIG. 2 depicts the static geometry properties of a Penetrator, its in-flight dynamics and the Euler solution compared to measured data from a gun launched Penetration event.

FIG. 2 depicts the common geometry features of a Penetrator body, that is, defines the nose, wall, shank, tail and body length features and its dynamic flight events of Ejecta and Cavitation, and contrasts acquired data of a Penetration event to the Euler Solution for an axial only Terraflight event thru a high density Terramedia.

Figure 3:
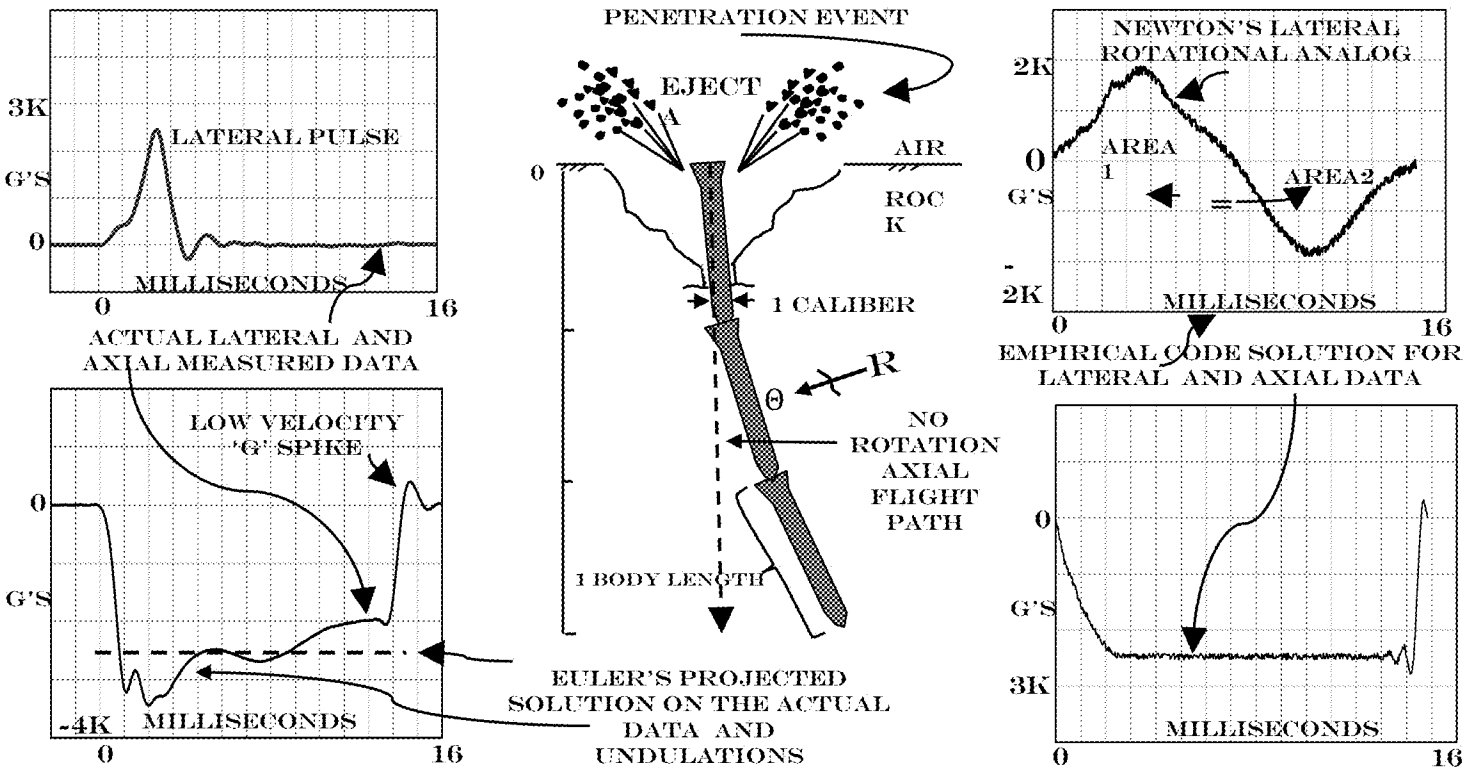
FIG. 3 are graphs of the lateral and axial 'g' loading of a Penetrator's measured data profiles and contrasts the measured data to National Laboratory Researcher's empirical code 'g' loading solutions for the same event.

FIG. 3 shows actual 'g' loading data from a 3-body length Terraflight of a Penetrator thru rock Terramedia with both actual axial (with Euler's projected solution overlayed) and lateral 'g' loading on the left-hand side of the figure and on the right-hand side contrasts the actual data to US National Laboratory researcher's empirical coded solutions for the lateral and axial 'g' loading of the same event.

Figure 4:
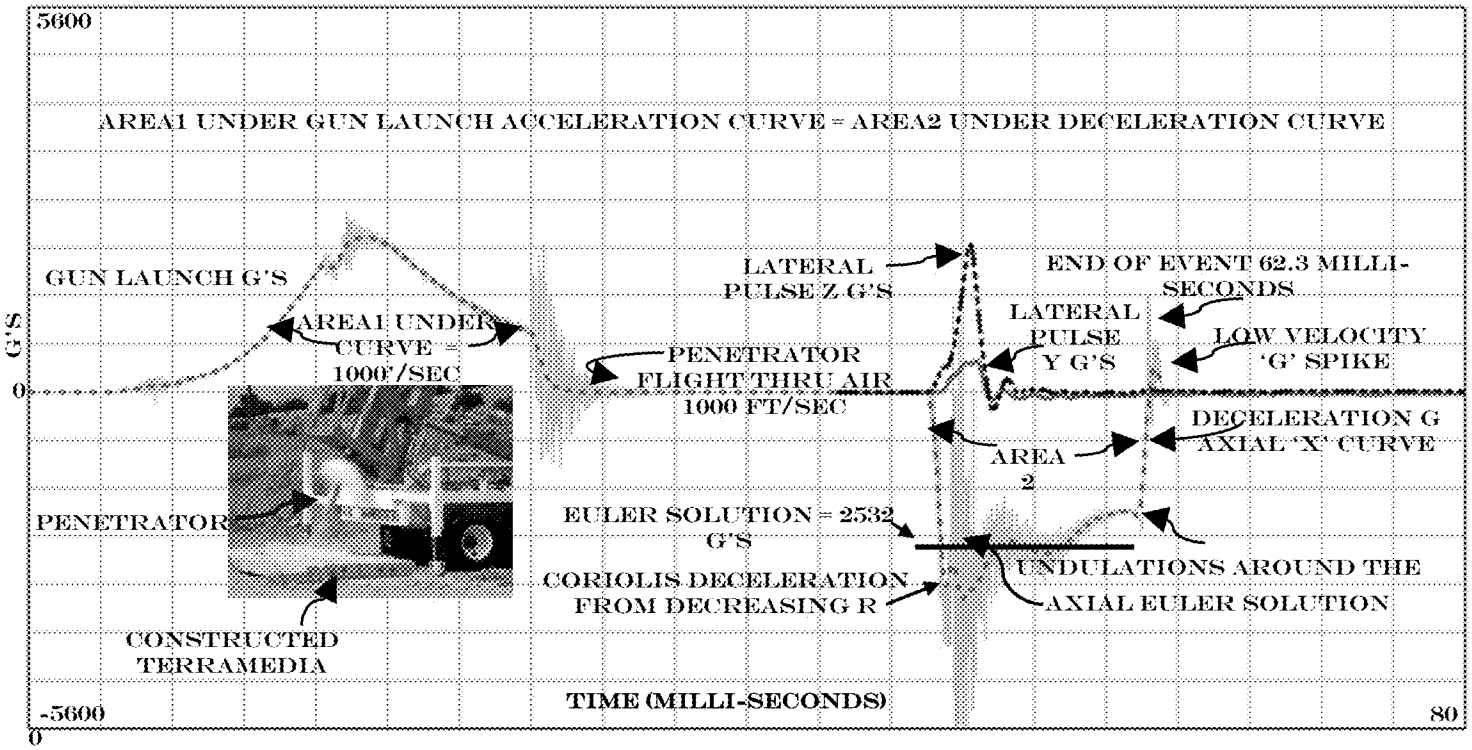
FIG. 4 shows the 'g' loading results from accelerometer sensors in 'x', 'y' and 'z' cartesian body co-ordinates for a gun launched Penetrator and its Terraflight thru a constructed geologic Terramedia.
Figure 8:
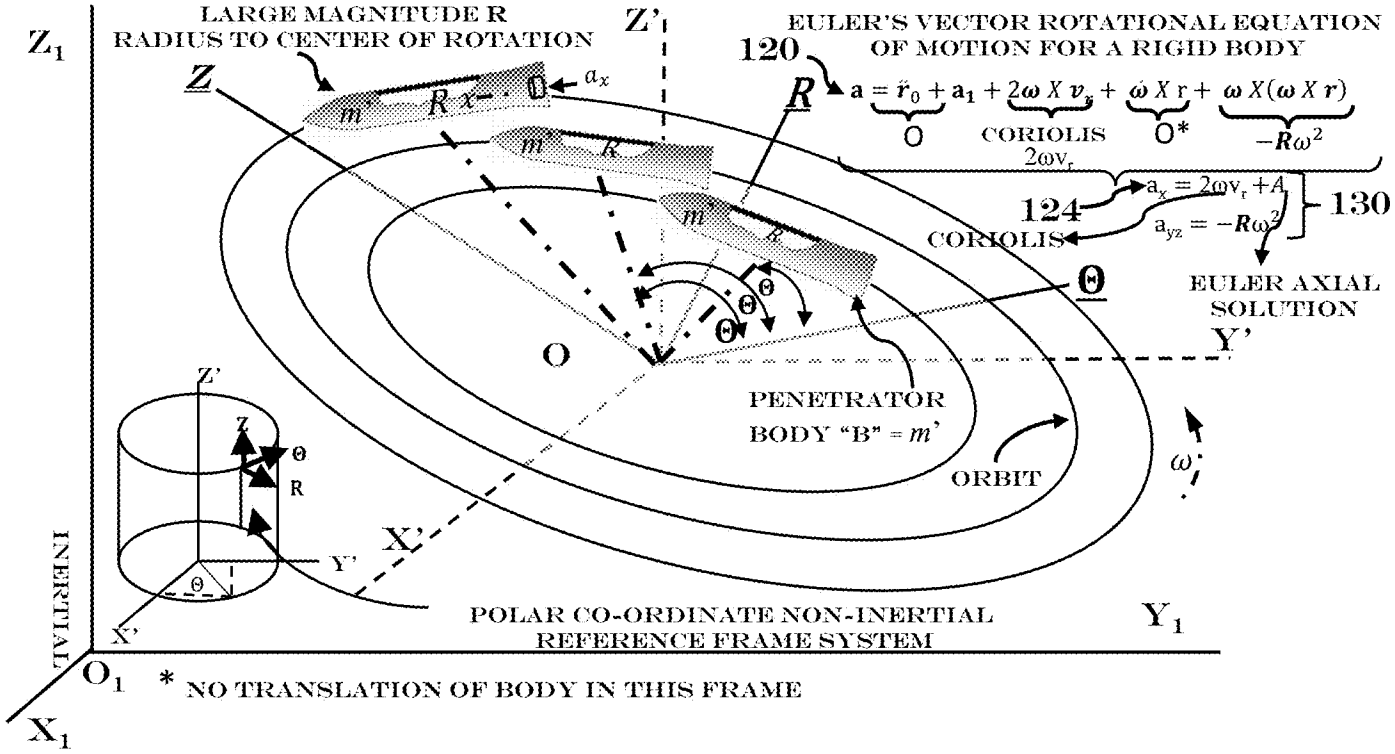
FIG. 8 is the solution to Euler's rotational rigid body vector equation of motion in a non-inertial "spatial" Penetrator frame in a polar co-ordinate system for strategically placed accelerometer sensors and unmasks the missing terms in the solution of FIG. 6.

FIG. 4 are 'x', 'y', 'z' Penetrator cartesian co-ordinate 'g' loading results from a gun launched Penetration event with initial conditions of 1000'/sec into a constructed Terramedia target and compares the results to the Euler "A" solution thereby identifying undulations around the Euler solution and demonstrating that lateral 'g' loading is vectorially transferred from the 'y' and 'z' axis to the 'x' axis via the Euler Coriolis acceleration and revealing and determining the existence of an additional non-inertial frame of reference, FIG. 8, that mathematically predicts the transfer.

Figure 5:
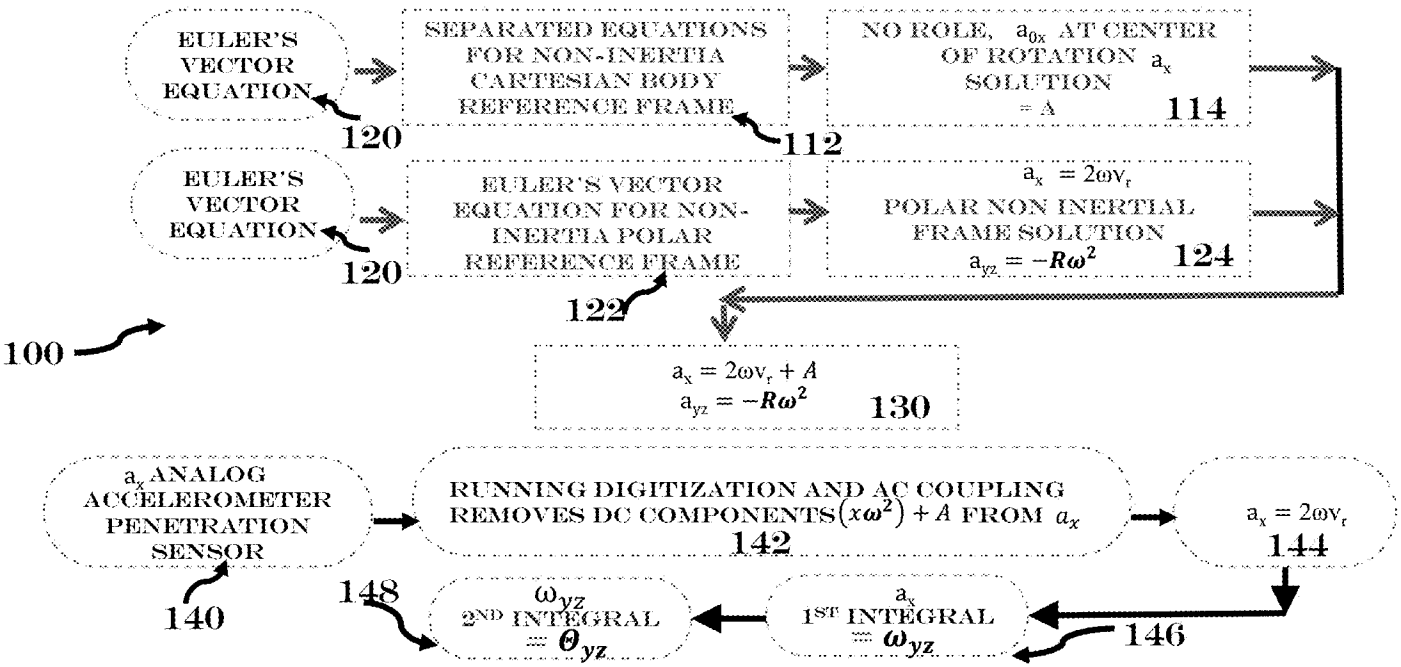
FIG. 5 is the running positional tracking solution to Euler's rotational rigid body vector equation of motion in two non-inertial frames and an algorithm to vector track a Penetrator's Terraflight thru Terramedia.

FIG. 5 is the algorithmic method, 100, of solving Euler's rotational rigid body vector equation of motion with one analog piezoresistive accelerometer measurement $a_x$ 140. Euler's vector equation, 120, is separated into 3 scalar equations, 112, in a cartesian non-inertial frame 'x', 'y' and 'z' and with the 'x' role term set to zero, 114, determining the Euler solution "A". Simultaneously Euler's vector equation in a polar non-inertial frame is separated returning the 'y' and 'z' spatial acceleration $R\omega^2$, 124, and that the $2\omega v_r$ Euler Coriolis acceleration is transferred to a x via the vector cross product in the polar non-inertial frame determining the final solution 130. The singular axial measurement 140, in running fashion, point by measured point, is digitized and AC coupled 142 to remove the DC terms, which are the Euler "A" solution and any $\omega^2$ accelerations, which are DC rectified terms. This operation yields the Euler Coriolis acceleration, that is, Euler's $2\omega v_r$, 144, term which is angular acceleration $\alpha_x$ ($Alpha_x$). $1^{st}$ and $2^{nd}$ running integrals, 146 and 148, are taken determining point by measured point the Penetration event's lateral angular velocity ω (Omega) and traversed path θ (Theta) in units of feet per second and feet. Dividing by the distance from $a_x$ to the point of rotation, which is the torque impulse location at the center of pressure, FIG. 2, on the nose, yields Omega in units of radians/sec and Theta in units of radians.

Figure 6:
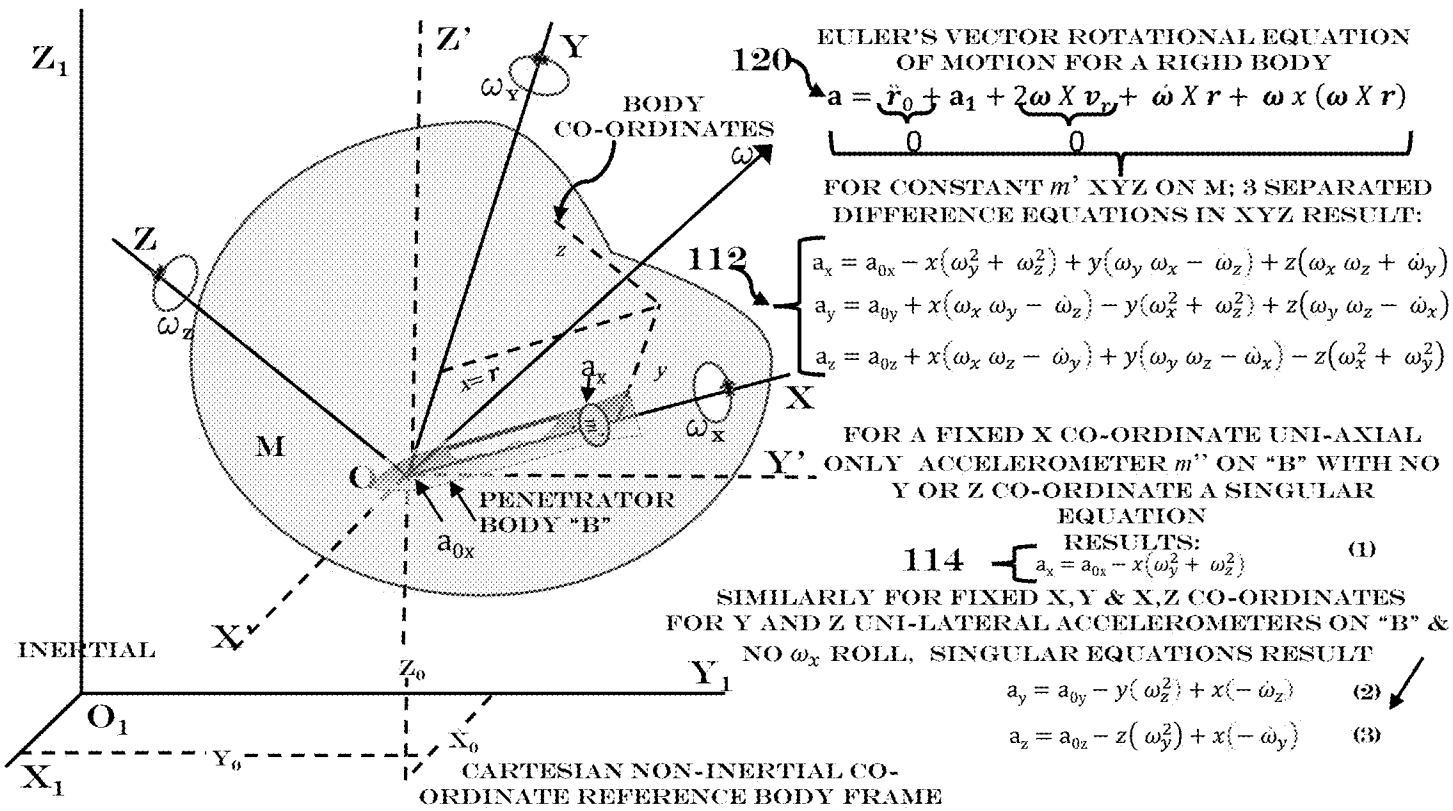
FIG. 6 is the solution to Euler's rotational rigid body vector equation of motion in a non-inertial Penetrator body frame in a cartesian co-ordinate system for strategically placed accelerometer sensors.

FIG. 6 separates Euler's rotational rigid body vector equation of motion into 3 scaler penetrator body difference equations in a non-inertial cartesian co-ordinate frame, 112, and reduces the axial equation to 114 for the case of a fixed 'x' co-ordinate uni-axial (no 'y' or 'z' co-ordinate) piezoresistive accelerometer sensor positioned as a constant mass m" on a Penetrator body "B" and also reduces the 'z' and 'y' separated scaler equations for fixed 'xz' and 'xy' co-ordinates, that is a singular 'y' facing sensor, FIG. 6; Eq. 2, with no 'z' and no $\omega_x$ roll co-ordinate and a singular 'z' facing sensor, Eq. 3, with no 'y' and no $\omega_x$ roll co-ordinate. This unveils the Euler Coriolis acceleration content in the signal allowing the scaler Euler Coriolis acceleration signal to be isolated from the total signal with AC Coupling.

Figure 7:
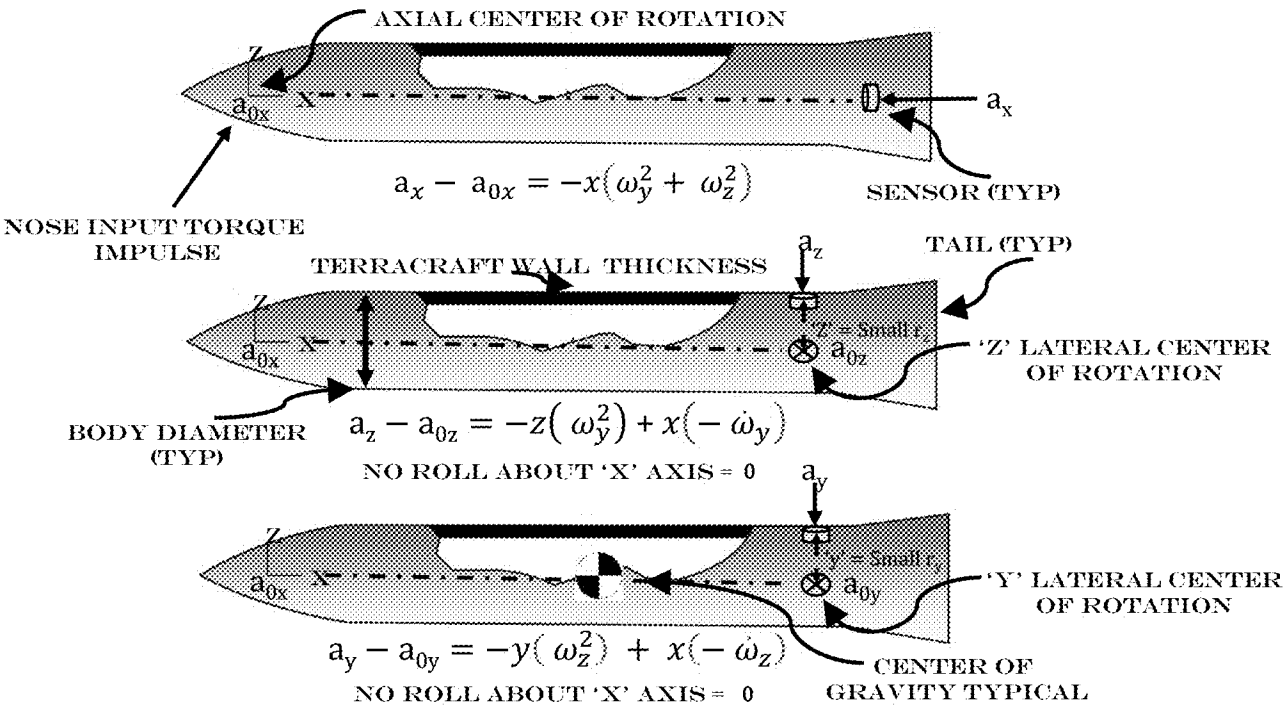
FIG. 7 is the Euler separated equations difference solutions in a non-inertial "body" Penetrator frame in a cartesian co-ordinate system and defines the dynamic and geometry features of the Penetrator and location of sensors with respect to their centers of rotation for a Penetration event.

FIG. 7 are the difference solutions for the non-inertial body "B" Penetrator frame in a Cartesian co-ordinate system and defines the dynamic and geometry features of the Penetrator and location of sensors $a_x$, $a_y$, $a_z$ and their centers of rotation for a Penetration event. The cartesian non-inertial frame solutions, FIG. 6; Eqs. 1, 2 and 3, for Euler's rotational rigid body vector equation of motion are rearranged in a difference form unlocking the rotational terms within the signal. For a singular sensor $a_x$ the axial 'x' longitudinal axis the solution $-x\ (w_y^2+w_z^2)$, FIG. 6; 114, only remains as there are no rotation around the 'y' and 'z' co-ordinates and in the same manner $a_y$ and $a_z$ and no 'z' or 'y' co-ordinate and no $\omega_x$ ($Omega_x$) roll yield $-y(\omega_z^2)+x(-\omega_z)$ and $-z(\omega_y^2)+x(-\omega_y)$, respectively.

FIG. 8 unmasks the missing terms, 130, of FIG. 6; Eqs. 1, 2 and 3 solutions to Eq. 120 in a cartesian co-ordinate system and details the polar non-inertial frame and the solution in this frame to Euler's rotational rigid body vector equation of motion, 120, and forecasts the scaler axial $2\omega v_r$ term, the Euler Coriolis acceleration, and further the $R\omega^2$ via the triple product of FIG. 8; 120, that is, the causal event that produces the lateral 'y' and 'z' pulses seen in FIG. 4. The Orbital 'R' is the spatial, not a body, radius to the center of rotation and starts at infinity for a perfectly straight Penetrator. This large spatial 'R', which relegates the Penetrator body "B" to a particle, m', within the polar non-inertial frame, produces substantially an order of magnitude greater acceleration then a body small radii, $\omega^2$ terms, which are the fixed cartesian co-ordinate vales of 'x', 'y', and 'z'. Body radius to the center of rotation are substantially inches while spatial large radii average many tens of feet over the sector Theta travel and for normal manufacturing tolerances start at 100's of feet for the manufacturing bow. This further relegates the $-y(\omega_z^2)$ and the $z(\omega_y^2)$ terms, Eqs. 2 and 3 on FIG. 6, a small percentage acceleration but does not completely annihilate their contribution to the 'y' and 'z' accelerations with respect to $R\omega^2$ but does relegate the terms to integral contaminates and must be removed to uncover the Euler Coriolis acceleration content in the signal. Further, while the $R\omega^2$ term overwhelms the lateral signals forcing them to appear as pulses, their removal with AC Coupling effectively unmasks the Euler Coriolis scaler accelerations.

Figure 9:
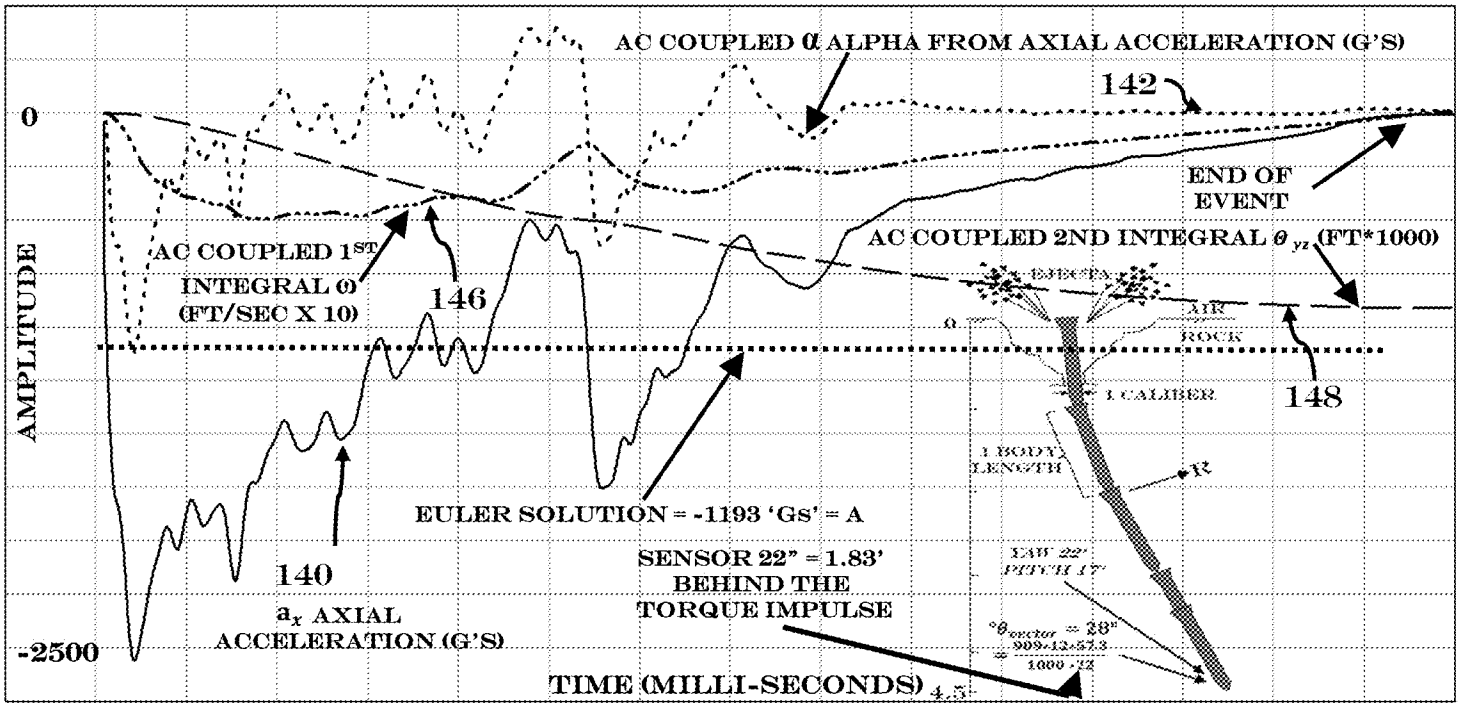
FIG. 9 is the verification of the algorithmic AC coupling method of obtaining the rotational properties of angular acceleration α(Alpha), angular velocity ω (Omega), and angular path θ (Theta) of an in-flight Penetrator with a singular sensor.

FIG. 9 details a single axial piezoresistive accelerometer, $a_x$, sensor solution that with an applied AC Coupling algorithm, 142, tracks the resultant vector, 148, of the Pitch (17°) and Yaw (22°), that is, the 28° (which is the square root of the sum of the squares of the Pitch and Yaw) vector total Θ (Theta) sector travel in radians and point by point. The sensor is positioned 22 inches behind the torque impulse. The undulations are shown around a superimposed totally axial Euler solution of −1193 'gs'. The AC coupling algorithm removes the DC components of the axial acceleration, that is, the Euler solution "A" and the $-x\ (w_y^2+w_z^2)$, FIG. 6; 114, contaminate solution for the Penetrator body in a cartesian non-inertial frame of FIG. 6, producing the AC coupled axial acceleration, 142, point by point, which is the $2\omega X\ v_r$ Euler Coriolis acceleration. The algorithm takes a running $1^{st}$ integral and simultaneously a running $2^{nd}$ integral producing ω angular velocity, 146, and θ (Theta) distance, 148, travelled in units of feet/sec and feet respectively. Division of each integral point by point by the sensor placement of 22" behind the torque impulse produces the rotational velocity and rotational travel in units of radians/sec and radians respectively.

Figure 10:
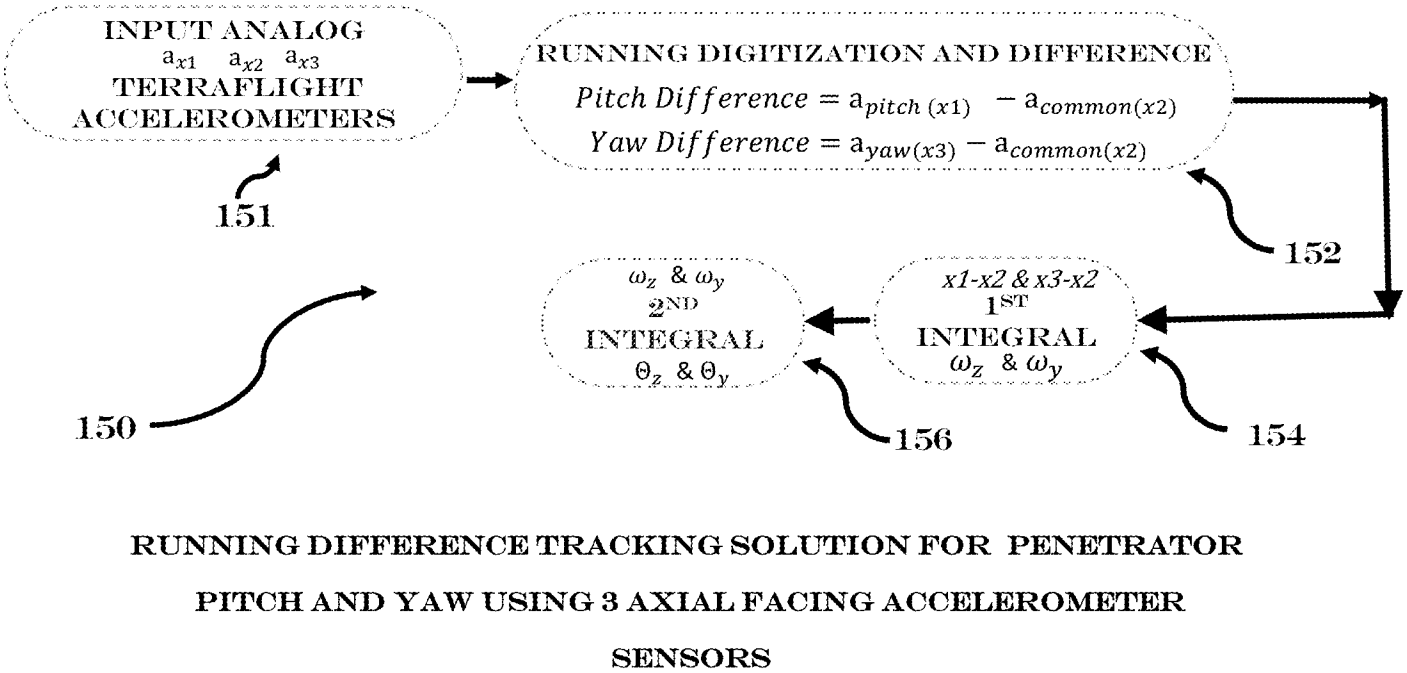
FIG. 10 is the algorithmic Penetrator tracking solution for Penetrator Terraflight Pitch and Yaw using three axial facing accelerometer sensors.

FIG. 10 is the algorithmic Penetrator tracking solution for Penetrator Pitch and Yaw using three axial facing planer accelerometer sensors with no 'y' or 'z' co-ordinates. Three piezoresistive accelerometers 151, termed $a_{x1}$, $a_{x2}$ and $a_{x3}$, are placed in a plane substantially near the back end of the Penetrator. A running digitization and difference 152 are taken with respect to $a_{x2}$; $a_{x1}$ being the Pitch sensor and $a_{x3}$ the Yaw sensor. Operation 152 yields point by measured point the Pitch acceleration and the Yaw acceleration in units of 'gs'. Running $1^{st}$ and $2^{nd}$ integrals 154 and 156 respectively are taken and point by point determine Pitch and Yaw angular velocity ω(Omega), and angular path Θ (Theta) in units of radians/sec and radians respectively, when each point is divided by the distances, r1 (Pitch) and r2 (Yaw) FIG. 11; 150, respectively.

Figure 11:
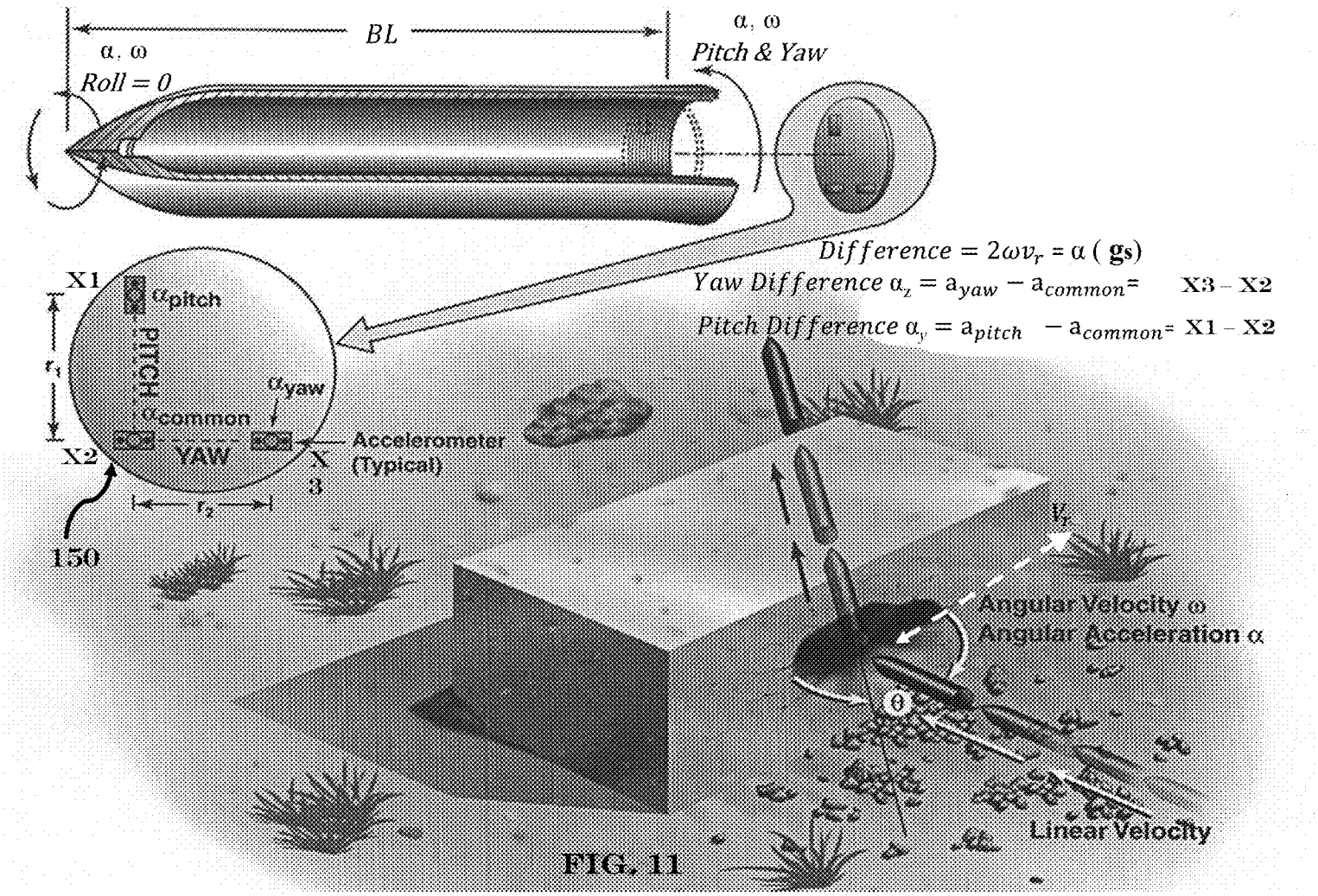
FIG. 11 shows the physical method and accelerometer sensor placement to extract the Pitch and Yaw components from a Penetrator in Terraflight and the Pitch and Yaw equations.

FIG. 11 is the geometry of the difference algorithms and accelerometer placement of FIG. 10 to parse Pitch and Yaw from a Penetration event. FIG. 11 shows the placement of 3 axial facing sensors, x1, x2 and x3 placed substantially at the rear of the Penetrator and defines the points of rotation $r_1$ (Pitch) and $r_2$ (Yaw) distances with respect to the common terminal accelerometer x2. The event shown is constructed concrete Terramedia. The 3 axial accelerometer difference method parses the Pitch and Yaw resultant from Euler's rotational rigid body vector equation of motion, FIGS. 6 and 8; 120, into its 'z' and 'y' components respectively. In each case the difference produces a scaler Alpha acceleration term $2\omega v_r$. Differencing is a close relative of AC coupling in that it removes the common modes from the two signals which in the case of Penetration is the Euler solution "A" of FIG. 1 and the $-x\ (w_y^2+w_z^2)$ 114 of FIG. 6. A signal that is squared on itself is an AC rectifier and produces a DC pulse and commonly used in electrical circuits, in both analog and digital electronics and power electronics to change AC to DC. The three accelerometer signals are placed in a plane 150 and in an "L" configuration. The "L's" horizontal and vertical intersection is the Common terminal, and must lie on the primary longitudinal axis, while the top of the "L" is the Pitch sensor and the sensor to the right of the Common terminal is the Yaw sensor. The dimensional spacing of the sensors is labeled $r_1$ (Pitch) and 12 (Yaw), FIG. 11. These dimensions are used on the $1^{st}$ 154 and $2^{nd}$ 156 integrals, FIG. 10, of the acceleration difference to change feet/sec to radians/sec and feet to radians respectively.

Figure 12:
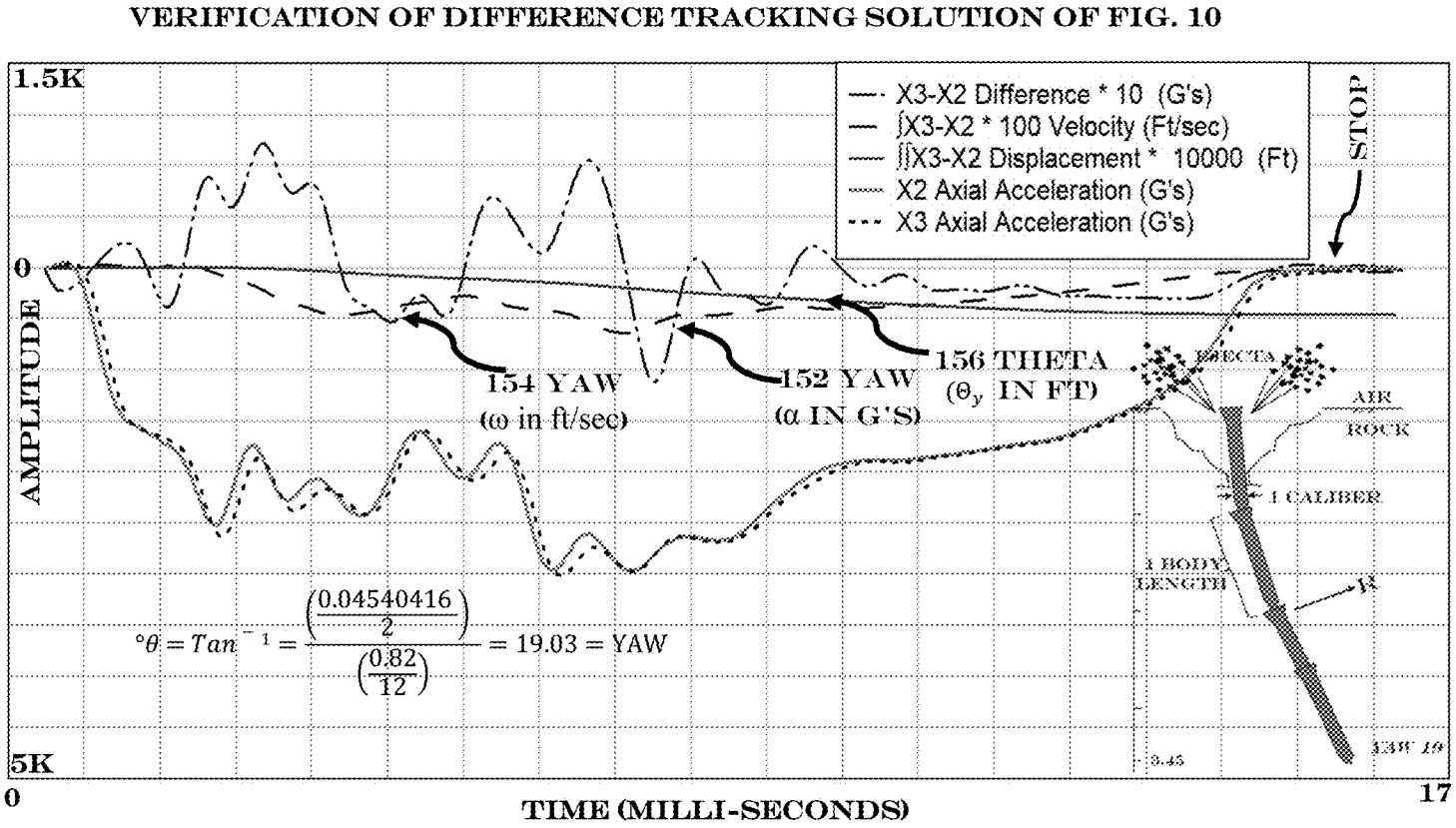
FIG. 12 is the verification of the algorithmic method of extracting the Pitch and Yaw components from a Penetrator in Terraflight and its rotational properties of angular acceleration α(Alpha), angular velocity ω (Omega), and angular path θ (Theta).

FIG. 12 is the verification of the algorithmic method of extracting the Pitch and Yaw components from an in-flight Penetrator and the rotational properties of angular acceleration α(Alpha), angular velocity ω (Omega), and angular path θ (Theta). The event is Terraflight thru a granite rock target that penetrated 3.45 body lengths with a striking velocity of 1000'/sec. It did not Pitch but Yawed 19°. The x3 sensor is subtracted from the common x2 sensor as shown on FIG. 11. The result is the undulations, 152, around the Euler solution are captured just as AC Coupling captured these features from a single accelerometer in FIG. 4. The $1^{st}$, 154, and $2^{nd}$ 156, integrals are taken, and the units of radians/sec and radians recovered by dividing by the Yaw spacing which is $r_2$. The spacing in this test was only 0.82 inches. This demonstrates the strength of the Euler Coriolis $2\omega v_r$ and the discovery's usefulness in extracting from an axial signal of an in-flight Penetrator its rotational properties of angular acceleration α(Alpha), angular velocity ω (Omega), and angular path θ (Theta) enabling the solution to Euler's rotational rigid body vector equation of motion, heretofore considered insoluble in closed form and implementation of a precision tracking algorithm.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue. Furthermore, these terms are also utilized herein to represent the degree by which a quantitative representation may vary from a stated reference due to manufacturing tolerances or fabrication tolerances. While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method to solve an Euler rotational rigid body vector equation of motion for an in-flight Penetrator thru a high density Terramedia and a determination of an inconstant vector Euler Coriolis acceleration Alpha dynamic 'g' loading with a running digitization and an AC coupling algorithm to remove an axial DC component $Omega^2$ and an axial DC Euler solution "A" from a single axial piezoresistive analog accelerometer and a running $1^{st}$ integral of the Euler Coriolis acceleration to determine a lateral angular vector velocity Omega and a running $2^{nd}$ integral of the Euler Coriolis acceleration to determine a traversed vector path Theta and an in-flight determination of the Penetrator's Euler rotational inconstant 'g' loading at all physical points on the Penetrator by:

Mounting the piezoresistive accelerometer analog electrical sensor on the primary longitudinal axis of the Penetrator ⅘ of the Penetrator body length behind a torque impulse at the Penetrator's nose;

Implement the running digitization of the piezoresistive accelerometer analog electrical sensor output signal and simultaneously run the AC coupling algorithm and remove the $Omega^2$ and the Euler "A" DC components from the piezoresistive accelerometer sensor's signal and determine the Euler Coriolis $Alpha_x$ acceleration;

Implement the running $1^{st}$ integral of the Euler Coriolis $Alpha_x$ acceleration and divide by the distance between the piezoresistive accelerometer analog sensor and the position of the Penetrator's nose torque impulse obtaining the vector rotational velocity Omega in radians/sec;

Implement the running $2^{nd}$ integral of the Euler Coriolis $Alpha_x$ acceleration simultaneously with the $1^{st}$ and divide by the distance between the piezoresistive analog electrical sensor and the distance to the Penetrator's nose torque impulse obtaining the vector trajectory angular path Theta traversed in radians.

2. A method to solve an Euler rotational rigid body vector equation of motion of an in-flight Penetrator for an Euler Coriolis scaler acceleration $Alpha_y$ and $Alpha_z$, a lateral angular velocity $Omega_y$ and $Omega_z$ and a traversed path $Theta_y$ and $Theta_z$ for a Pitch and a Yaw solution for rotation of the Penetrator from the Euler rotational rigid body vector equation of motion for a rigid body using a three axial facing piezoresistive analog acceleration sensor configuration in an "L" pattern with a running digitization, a difference algorithm to remove common modes, a running $1^{st}$ integral of the Euler Coriolis acceleration $Alpha_y$ and $Alpha_z$ to determine the lateral angular velocities $Omega_y$ and $Omega_z$ and a running $2^{nd}$ integral of the Euler Coriolis acceleration $Alpha_y$ and $Alpha_z$ to determine the traversed vector paths $Theta_y$ and $Theta_z$ for the Penetrator Pitch and the Yaw by:

Mounting the three piezoresistive axial facing accelerometer analog electrical sensors on the longitudinal axis of the Penetrator and 4/5 of the Penetrator body length behind a torque impulse on the Penetrator's nose;

Implement the running digitization and the difference algorithm of the piezoresistive "L" accelerometer sensors output signals designating the sensor on the top of the "L" the Pitch difference Alpha, with respect to a Common accelerometer sensor at the intersection of the vertical and horizontal legs of the "L" and placed on the primary longitudinal axis of the Penetrator and designating the acceleration sensor on the right of the "L" the Yaw difference $Alpha_z$ with the respect to the Common accelerometer sensor;

Implement the running $1^{st}$ integral of the Pitch difference acceleration signal $Alpha_y$ and divide by the physical distance between the Pitch sensor and the Common sensor and simultaneously run the $1^{st}$ integral of the Yaw difference acceleration signal $Alpha_z$ and divide by the physical distance between the Yaw sensor and the Common sensor to obtain the lateral angular velocities $Omega_y$ and $Omega_z$;

Implement the running 2nd integral simultaneously with the $1^{st}$ integral of the Pitch difference acceleration signal $Alpha_y$ and Yaw difference acceleration signal $Alpha_z$ and divide by the physical distances between the Pitch sensor and the Common sensor and the Yaw sensor and the Common sensor respectively to obtain the traversed paths $Theta_y$ and $Theta_z$.

* * * * *